United States Patent [19]

Eck

[11] Patent Number: 4,780,902

[45] Date of Patent: Oct. 25, 1988

[54] ROTARY ANODE FOR X-RAY TUBES

[75] Inventor: Ralf Eck, Tränke, Austria

[73] Assignee: Schwarzkopf Development Corporation, New York, N.Y.

[21] Appl. No.: 876,763

[22] Filed: Jun. 20, 1986

[30] Foreign Application Priority Data

Jul. 11, 1985 [AT] Austria ..... 2053/85

[51] Int. Cl.[4] ..... H01J 35/10

[52] U.S. Cl. ..... 378/144; 378/125; 378/143

[58] Field of Search ..... 378/144, 143, 125, ; 252/506, 507, 518, 520; 420/429

[56] References Cited

U.S. PATENT DOCUMENTS

| | | | |
|---|---|---|---|
| 3,169,860 | 2/1965 | Semchgshen | 420/429 |
| 3,328,626 | 6/1967 | Natter et al. . | |
| 3,689,795 | 9/1972 | Benesorsky | 378/144 |
| 3,836,807 | 9/1974 | Schreiner et al. | 378/144 |
| 4,165,982 | 8/1979 | Tatsuo et al. | 420/429 |

FOREIGN PATENT DOCUMENTS

| | | |
|---|---|---|
| 248555 | 8/1966 | Austria . |
| 257751 | 10/1967 | Austria . |
| 1121407 | 7/1968 | United Kingdom . |

*Primary Examiner*—Carolyn E. Fields
*Assistant Examiner*—David P. Porta
*Attorney, Agent, or Firm*—Morgan & Finnegan

[57] ABSTRACT

Rotary anodes for X-ray tubes are provided having improved thermal stability. The rotary anodes are comprised of a basic body made of molybdenum alloy comprising about 0.1 to 15% by weight hafnium, about 0.1 to 15% by weight zirconium, about 0.01 to 1.0% by weight carbon and the balance molybdenum.

The alloy according to the invention has a low tendency of cracking distortion, and/or surface roughening, even with focal track zones made of tungsten and tungsten alloys and even at operating temperatures exceeding the currently normal values by up to about 200° C.

3 Claims, No Drawings

ROTARY ANODE FOR X-RAY TUBES

BACKGROUND OF THE INVENTION

This invention relates to rotary anodes for X-ray tubes comprised of a basic body and made of a molybdenum alloy.

Of the total electric energy supplied to a rotary anode for producing X-radiation, only about 1% is converted into X-rays: the remaining 99% is converted into heat. Therefore, materials for rotary anodes have to be suitable for producing the required X-radiation and, at the same time, exhibit high thermal stability.

Tungsten has both a very high melting point and high ordinal number in the periodic system and thus was found to be highly suitable as a material for the focus path producing the X-rays or the basic body of rotary anodes. However, the drawback of tungsten is that it is very difficult to shape; furthermore, its specific weight is very high, so that the rate of acceleration and deceleration of such rotary anodes can only be relatively low. The centrifugal forces occurring during rotation are, however, very high, so that the maximum permissible number of revolutions of said rotary anodes is relatively low.

In the past, in order to avoid said drawbacks, manufacturers have changed the make-up of such rotary anodes by using tungsten or a tungsten/rhenium alloy only for producing the track of the focal spot, which emits the X-rays, whereas molybdenum or molybdenum alloys, which are substantially lighter in weight than tungsten, are used for manufacturing the basic body of the rotary anodes.

For example, the use of an alloy based on molybdenum with additions of from 0.5 to 50% tungsten, tantalum, niobium, rhenium and/or osmium for producing the basic body of rotary anodes is described in Austrian Patent AT-PS No. 248,555. However, when said rotary anodes are highly stressed, the difference in thermal expansion between the basic body made of the molybdenum alloy and the track of the focal spot made of tungsten or tungsten alloy has an adverse effect, which may cause cracking of the track of the focal spot, these cracks may extend into the basic body.

Austrian patent AT-PS 257,751 describes a rotary anode for X-ray tubes with a basic body consisting of a molybdenum alloy containing 0.05 to 1.5% by weight titanium and additionally, if need be, up to 0.5% by weight zirconium or 0.3% by weight carbon. Said molybdenum alloy is known as "TZM". By using "TZM" as the material for the basic body it was possible to significantly reduce the tendency of cracking.

However, the track of the focal spot for these types of rotary anodes may become distorted in the course of time. Such distortion is more frequent and serious at higher operating temperatures and for larger diameter rotary anodes. Distortion (which may be so minor that it cannot be noticed by the naked eye) results in a reduced yield of X-radiation because a portion of the X-radiation is cut off along the periphery of the X-ray window.

Accordingly, it is an object of the present invention to provide a rotary anode for X-ray tubes in which the basic body comprises a molybdenum alloy but wherein the known problems of said alloy, such as cracking or distortion of the rotary anode, are reduced or avoided.

SUMMARY OF THE INVENTION

According to the invention, said objective is accomplished by using a molybdenum alloy comprising about 0.1 to 15% by weight hafnium, about 0.1 to 15% by weight zirconium, about 0.01 to 1.0% by weight carbon and the balance molybdenum.

In a particularly preferred embodiment of the invention, the molybdenum alloy comprises about 0.1 to 2.0% by weight hafnium, about 0.1 to 2.0% by weight zirconium, about 0.01 to 0.5% by weight carbon and the balance molybdenum.

DETAILED DESCRIPTION OF THE INVENTION

As compared to a TZM-alloy, the anode according to the invention has enhanced mechanical properties even at operating temperatures of rotary anodes in the range of about 1000° and 1500° C., at which temperatures the enhanced mechanical properties offer a significant improvement in the strength of the rotary anode.

Tensile strength tests were carried out as described in Example 1 using test rods made of the subject alloys to demonstrate the enhanced mechanical strength of the alloys according to the invention as compared to "TZM", particularly at the temperatures used in the operation of rotary anodes.

In Example 1, the compositions of the alloys were varied ranging in the case of the alloy for the basic body of the rotary anode of the invention from 0.4 to 0.7% by weight Zr, from 0.15 to 1.2% by weight Hf, from 0.05 to 0.15% by weight C; and in the case of the TZM-alloy from 0.5% by weight Ti, 0.08% by weight Zr and from 0.01 to 0.04% by weight C. The test rods were produced by compressing and sintering initial powders and subsequent hot forging until complete compression was achieved.

Specifications with respect to the test are as follows: Gauge length diameter of the test rods: 2.5 mm; diameter of the clamping heads = 5 mm; gauge length 10 mm; gauge length roughness $R_a = 1.6$ um. The measurements were carried out in a hot tearing furnace with cold-wall vessel under $H_2$ as protective gas; TP lower than −35° C.

Example 1

| Test Temperature | Tensile Strength | |
|---|---|---|
| | TZM | Alloy of the invention |
| 950° C. | 430–570 N/mm$^2$ | 630–780 N/mm$^2$ |
| 1100° C. | 340–485 N/mm$^2$ | 570–700 N/mm$^2$ |
| 1250° C. | 250–400 N/mm$^2$ | 510–620 N/mm$^2$ |
| 1400° C. | 140–150 N/mm$^2$ | 300–400 N/mm$^2$ |

The recrystallization temperature of the alloy of the invention exceeds the temperature of a TZM-alloy by about 150 to 250° C. For example, TZM was found to be partially recrystallized after only one hour of annealing at 1350° C., whereas the alloy according to the invention recrystallizes at a temperature above 1500° C. Therefore, by using the alloy of the invention for the basic body of rotary anodes, the operating temperature of rotary anodes may be significantly increased without causing a steep drop in the mechanical strength due to early or premature recrystallization.

Owing to the increased recrystallization temperature, the fatigue strength at the operating temperature range of the rotary anodes is significantly increased. Even in the event of recrystallization, the fatigue strength of the alloy of the invention is enhanced as compared to TZM because following recrystallization, the structure of the alloy of the invention is significantly more finely granular than that for TZM. Owing to said properties, the useful or service life of the rotary anodes of the invention is substantially prolonged.

The most important advantage gained by using the alloy of the invention for producing the basic body of rotary anodes is that the phenomena of distortion of rotary anodes is nearly completely avoided to a surprising extent, during both the manufacture and operation of the rotary anodes.

The most conclusive value for distortion for rotary anodes is the creep strength of the basic material. To demonstrate the excellent creep strength of the alloy used in making the basic body of the rotary anode of the invention, creep break times and minimum creep rates were determined as shown in Example 2 and compared to TZM.

The creep strength measurements in Example 2 were carried out in the same furnace on the same type of test rods as used in Example 1 for measuring tensile strength. The test rods were subjected to a heat treatment in the course of their manufacture to some extent.

Example 2

| Load and Temperature | Heat Treatment During Manufacture | TZM | Alloy of the Invention |
|---|---|---|---|
| | | Creep Break Time | |
| 450 N/mm$^2$ 1000° C. | without heat treatment | 0.01 h | 35–47 h |
| | with heat treatment | 0.01 h | 418–428 h |
| | | Minimum Creep Rate | |
| | without heat treatment | 8.3%/min | 1,135.10$^{-3}$–8,310.$^{-4}$%/min |
| | with heat treatment | 8.3%/min | 9,73.10$^{-4}$–6,0.10$^{-4}$%/min |

Preferably, the rotary anodes according to the invention are manufactured by the known procedure: by composite compression, sintering and forging of the initial materials used for the basic body and the focal track. Alternatively, the anodes can be manufactured by joining the basic body and the coating for the focal track and by forging after first producing the basic body and focal track which are manufactured via compressing, sintering and forging.

Especially in the production of rotary anodes with a focal track coating comprising tungsten or a tungsten/rhenium alloy, the manufacturing process for the anodes of the invention is advantageously enhanced in that the alloy of the invention has the advantage that its increase resistance to dimensional changes is very close to that for tungsten or tungsten/rhenium material used for producing the focal track, resulting in a cooperation in the flow behavior of the materials for the focal track and basic body. The difference in flow behavior for the two materials used in making conventional rotary anodes is one of the unfavorable aspects thereof. Furthermore, because the values of thermal strength and thermal stability of the materials of the invention are close, manufacture of the rotary anodes is enhanced in that the required heat treatment may be carried out at a higher temperature. By suitably selecting the temperatures and times of heat treatment and taking into account the degree and rate of reshaping in the manufacture of the rotary anodes, it is possible to significantly improve thermal strength, stability and fatigue properties as compared to known rotary anodes, particularly as compared to rotary anodes produced from known molybdenum alloys. This means that other important property improvements can be achieved in addition to the excellent resistance to distortion of the rotary anodes of the invention.

The significance of such improvements is that the quality and function of X-ray rotary anodes used in known systems is enhanced. In addition, the rotary anodes of the invention may be used commercially in the new technologies, for example, in the field of computer tomography, where rotary anodes with comparatively very large dimensions are required.

What is claimed is:

1. A rotary anode for X-ray tubes comprised of a basic body made of a molybdenum alloy consisting essentially of about 0.1 to 15% by weight hafnium, about 0.1 to 15% by weight zirconium, about 0.01 to 1.0% by weight carbon, and the balance molybdenum.

2. The rotary anode for X-ray tubes according to claim 1 wherein the molybdenum alloy consists essentially of about 0.1 to 2.0% by weight hafnium, about 0.1 to 2.0% by weight zirconium, about 0.01 to 0.5% by weight carbon, and the balance molybdenum.

3. The rotary anode of claim 1 wherein the rotary anode has a shaft and wherein said basic body and said shaft consist essentially of said molybdenum alloy.

* * * * *